United States Patent [19]

Brischoux

[11] Patent Number: 4,915,407

[45] Date of Patent: Apr. 10, 1990

[54] BINDING WITH INDEPENDENTLY ACTING RELEASE AND RETENTION FEATURES

[75] Inventor: Jean-Claude Brischoux, Seynod, France

[73] Assignee: Salomon S.A., Annecy Cedex, France

[21] Appl. No.: 64,113

[22] Filed: Jun. 19, 1987

[30] Foreign Application Priority Data

Jul. 4, 1986 [FR] France ..... 86 10236

[51] Int. Cl.[4] ..... A63C 9/084

[52] U.S. Cl. ..... 280/626; 280/634; 280/631; 280/632

[58] Field of Search ..... 280/615, 611, 614, 626, 280/628, 631, 632, 633, 634, 620

[56] References Cited

U.S. PATENT DOCUMENTS

| | | | |
|---|---|---|---|
| 3,689,095 | 9/1972 | Salomon | 280/628 |
| 3,873,112 | 3/1975 | Covini | 280/620 |
| 4,218,071 | 8/1980 | Salomon | 280/630 |
| 4,307,895 | 12/1981 | Storandt et al. | 280/632 |
| 4,384,733 | 5/1983 | Krob et al. | 280/632 |
| 4,402,525 | 9/1983 | Salomon | 280/628 |
| 4,538,828 | 9/1985 | Salomon | 280/628 |
| 4,553,772 | 11/1985 | Boussemart et al. | 280/628 |
| 4,603,880 | 8/1986 | Salomon | 280/628 |
| 4,714,267 | 12/1987 | Abondance et al. | 280/615 |

FOREIGN PATENT DOCUMENTS

| | | |
|---|---|---|
| 0305106 | 12/1980 | Austria . |
| 2250726 | 1/1974 | Fed. Rep. of Germany . |
| 2628748 | 12/1977 | Fed. Rep. of Germany . |
| 2916348 | 11/1979 | Fed. Rep. of Germany . |
| 2838903 | 3/1980 | Fed. Rep. of Germany . |
| 3104633 | 12/1981 | Fed. Rep. of Germany . |
| 2027531 | 10/1970 | France . |
| 2031883 | 11/1970 | France . |
| 2138694 | 1/1973 | France . |
| 2238060 | 2/1975 | France . |
| 2248680 | 5/1975 | France . |
| 2258876 | 8/1975 | France . |
| 2314742 | 1/1977 | France . |
| 2338060 | 8/1977 | France . |
| 2385418 | 10/1978 | France . |
| 2418656 | 9/1979 | France . |
| 2419737 | 10/1979 | France . |
| 2420359 | 10/1979 | France . |
| 2424037 | 11/1979 | France . |
| 2424037 | 11/1979 | France . |
| 2458299 | 1/1981 | France . |
| 2469189 | 5/1981 | France . |
| 2470619 | 6/1981 | France . |
| 2480130 | 10/1981 | France . |

*Primary Examiner*—David M. Mitchell
*Assistant Examiner*—Richard Camby
*Attorney, Agent, or Firm*—Sandler & Greenblum

[57] ABSTRACT

A safety binding adapted to releasably hold a boot on a ski, including a device for securing the binding to the ski, a movable body with spaced lateral arms pivotably connected to the securing device, a jaw pivotably connected to the body which includes a device for engaging and holding a portion of the boot, and a device, which include a rocking lever, for biasing the jaw and the body towards the ski and for increasing the bias on the jaw in response to upward movement of the body. A platform, adapted to connect a safety binding to a ski, includes opposed side recesses adapted to be attached to the binding, and an inclined projection extending upwardly from the platform which includes a device for slidably engaging a device for biasing the binding toward the ski. A safety binding for a ski boot adapted to retain one end of the boot and to free that end when it exerts a force on the binding exceeding a predetermined threshold. The binding includes a movable body adapted to be connected to the ski by two lateral arms, a movable jaw adapted to retain the end of the boot and including a ramp located on its inner surface, an energization device including an elastic energy storage device, pushing elements, and a rocking lever, and a device for supporting the body which is adapted to be attached to the ski.

71 Claims, 8 Drawing Sheets

BINDING WITH INDEPENDENTLY ACTING RELEASE AND RETENTION FEATURES

BACKGROUND OF THE INVENTION

1. Field of the Invention

The present invention relates to a safety binding for a ski boot. More particularly, the invention relates to a binding, particularly a rear binding, which is adapted to retain one end of the boot, particularly its heel, on the ski, and to free this end when the boot exerts a force exceeding a predetermined threshold on the binding.

2. Description of Background and Relevant Information

Bindings of this type are known which comprise a body attached to the ski, directly or by means of longitudinal adjustment means, and a movable jaw which is journalled with respect to the body around a transverse axis. Energization means further assure the elastic return of the jaw in the direction of the ski.

A binding of this type is for example described in French Pat. No. 2,238,060.

Such bindings assure a satisfactory safety for the skier, but they have the disadvantage of having an elastic extent of small amplitude. The elastic extent designates, in current terms, the distance which the end of the shoe under consideration can space itself vertically from the ski, before causing the release of the binding, and thus its liberation.

Likewise bindings are known whose jaw and body constitute a one-piece assembly, journalled in rotation around a transverse axis at the end of two lateral arms, these two arms being themselves journalled with respect to the ski at the level of their other end.

Such a binding is for example described in French Pat. No. 2,258,876.

The bindings of this type have an elastic extent of an increased amplitude, but a poorer retention of the foot than the preceding bindings. The retention of the foot corresponds to the firmness with which the shoe is returned towards the ski at the beginning of its elastic extent.

The retention of the foot of certain bindings of this type has been improved by adjusting the elastic return of the binding. The elastic return designates, in current terms, the longitudinal sliding of the body of the binding on a slide and the elastic return of this body towards the other binding, which causes the jaw of the binding to exert on the end of the shoe a longitudinal pressure directed towards the other binding. It is known that the elastic return is particularly advantageous to absorb the flexional movements of the ski without inordinately biasing th release mechanism of the binding.

One of the means to compensate for the absence of retention of the foot by the elastic return consists of adopting a limited extent of retraction for the binding, and utilizing elastic return springs of low rigidity. In this manner, as soon as the boot is inserted, the binding retracts and abuts in retraction. Such a construction has the disadvantage that, during skiing, the flexional movements of the ski cannot be absorbed by the elastic return of the binding, because the binding is in abutment, and as a result it is the release mechanism which operates.

Another compensation means consists of rigidifying the return springs with elastic retraction. Such a construction however has the same disadvantage as previously, i.e., that the flexional movements of the ski are absorbed partially by retraction springs and principally by the release mechanism of the binding.

Likewise, the bindings of this type have the disadvantage of requiring auxiliary return springs to bring back the arms and the body of the binding in the direction of the ski.

SUMMARY OF THE INVENTION

The present invention is directed to a safety binding, adapted to releasably hold a boot onto a ski, which includes means for securing the binding to the ski; a movable body with spaced lateral arms pivotably connected to the securing means along an axis which is substantially transverse to the longitudinal extent of the ski; and a jaw, pivotably connected to the movable body along an axis which is substantially transverse to the longitudinal extent of the ski. The jaw includes means for engaging and holding a portion of the boot on the securing means when the boot is positioned on the securing means and the binding is attached to the ski, the binding includes means for biasing the jaw and the movable body towards the ski and for increasing the biasing force exerted by the biasing means on the jaw in response to upward movement of the movable body, and the means for increasingly biasing the jaw towards the ski include a rocking lever.

In one particular embodiment the means for securing the binding to the ski may be adapted to be pivotably connected to the upper surface of the ski along a vertical axis which is substantially perpendicular to the upper surface of the ski. The securing means may include a platform, the upper surface of which supports the sole of the boot, which has two lateral surfaces adapted to receive the spaced lateral arms of the movable body. The platform may further include an extension which rises upwardly on the upper surface of the ski and which forms a platform ramp.

In a preferred embodiment, the lateral surfaces of the platform which are adapted to receive the spaced lateral arms are substantially parallel to each other and to the longitudinal extent of the ski.

In another preferred embodiment, each of the spaced lateral arms includes a first portion which commences at its point of attachment of the arm to the platform and extends along the lateral surface of the platform towards the binding, and a second portion, extending from the first portion, which rises from the upper surface of the ski towards the binding. Preferably, the spacing between the lateral arms is less than or equal to the width of the sole of the boot.

The jaw of the binding includes an upper extension adapted to engage the upper surface of the sole of the boot, a lower extension adapted to engage a bottom surface of the sole of the boot, and a ramp located on an inner surface of the jaw. The jaw ramp includes an upper compressive zone, a lower opening zone adjacent to the compressive zone, and a ridge positioned between the two zones.

The biasing means of the safety binding include elastic energy storage means, a pushing element in contact with the elastic energy storage means, means for transferring the elastic energy between the pushing element and the jaw ramp. Means are also provided for adjusting the amount of elastic energy stored in the elastic energy storage means.

The energy transferring means of the body may include the rocking lever, which has a middle portion in contact with the pushing element and an upper arm with an end which constitutes the pressure element which slidably contacts the jaw ramp. The rocking lever may also have a lower arm with an end which constitutes a pressure nose which slidably contacts the platform ramp.

In an alternative embodiment, the extension of the platform may include a pressure nose, and the rocking lever may have a lower arm having a ramp slideably contacting the platform pressure nose. The rocking lever ramp may comprise means for compressing the elastic energy storage means when the body pivots upwardly away from the ski. In a preferred embodiment, the rocking lever ramp includes a projecting lip at its lower portion, which comprises means for limiting movement of the safety binding away from the ski.

The binding may further include a manual release lever which can be operated to allow disengagement of the boot from the binding.

In an alternative embodiment, the means for securing the binding to the ski are adapted to be slidably connected to the ski along at least a portion of the longitudinal extent of the ski, and the binding may additionally include means for elastically returning the binding along the sliding means in one predetermined direction. The elastic return means may include springs.

In the embodiment wherein the securing means are adapted to be pivotably connected to the upper surface of the ski along a vertical axis substantially perpendicular to the upper surface of the ski, the platform and the extension are both connected to the ski and may be spaced apart from each other. In another particular embodiment, wherein the platform is not pivotably connected around the vertical axis, the platform and the extension may be sufficiently spaced apart from each other along the longitudinal extent of the ski so as to be substantially on opposite sides of the movably body.

Preferably, the upper compressive zone is shaped so that as the jaw pivots upwardly away from the ski and the pressure element slides along the upper compressive zone in the direction of the opening zone, the elastic energy storage means are increasingly compressed, which exerts increasing force on the pressure element and biases the jaw towards the ski with increasing force. When the force moving the jaw upwardly exceeds a predetermined threshold and the pressure element passes over the ridge and into the opening zone, the opening zone permits decompression of the elastic energy storage means, whereby the jaw is biased upwardly from the ski and the boot is released.

In one particular embodiment the pushing element of the biasing means includes a rocker arm, which is pivotably connected to the movable body along an axis which is substantially transverse to the longitudinal extent of the ski. The rocker arm may be in contact with a middle portion of the rocking lever previously described. In one particular embodiment the rocker arm may include first and second ends, with the transverse axis along which the rocker arm is connected to the body located at the first end; the second end in contact with the elastic energy storage means; and a portion between the first and second ends in contact with the energy transferring means.

In the embodiment wherein the platform is adapted to be pivotably connected to the upper surface of the ski along a vertical axis substantially perpendicular to the upper surface, the binding may be provided with means for limiting the extent of pivotable movement of the platform. In a preferred embodiment these limiting means include first and second spaced projections, attached to respective edges of the platform, and an abutment adapted to be attached to an upper surface of the ski in spaced relationship to the platform. The projections are adapted to engage the abutment when the platform pivots around the vertical axis.

In a particularly preferred embodiment, the binding includes means for biasing the platform back towards a centered position with respect to the longitudinal extent of the ski. These biasing means may include means for compressing the elastic energy storage means when the platform pivots away from a central position.

The present invention further includes a platform adapted to connect a safety binding to a ski. The platform includes a lower surface adapted to be attached to the ski, opposed side recesses adapted to be attached to the binding, and a ramp, inclined to extend upwardly beyond an upper horizontal support surface of the platform, which comprises means for slidably engaging a device for biasing the binding towards the ski. In a preferred embodiment the ramp includes a projecting lip in its upper portion, which limits the upper motion of the means for slidably engaging the biasing device and limits the amount to which the safety binding may become distanced from the ski. The recesses extend, with respect to the longitudinal extend of the ski, along a major portion of the length of the platform, and the platform includes a bore, extending transversely through the width of the platform and emerging within each of the side recesses. The bore defines an axis to which two lateral arms of the safety binding may be connected.

In another embodiment, the platform is adapted to be pivotably connected along a substantially vertical axis with respect to the upper surface of the ski, and an abutment is adapted to be attached to an upper surface of the ski in spaced relationship from the platform. Two spaced projections are attached to respective edges of the platform, and the projections are adapted to engage the abutment as the platform pivots around the vertical axis.

In a further embodiment the present invention includes a safety binding for a ski boot adapted to retain one end of the boot and to free that end when it exerts a force on the binding exceeding a predetermined threshold.

The binding includes a movable body adapted to be connected to the ski by two lateral arms, which are journalled at their lower end around an axis transverse to the longitudinal extent of the ski; a movable jaw, adapted to retain the end of the boot, journalled to the body around an axis transverse to the longitudinal extent of the ski and including a jaw ramp; energization means, which include elastic storage means, a pushing element which which pushes a pressure element against the jaw ramp, and a rocking lever having first and second arms which is journalled to the pushing element, with the end of the first rocking lever arm constituting a pressure element that slidably contacts the jaw ramp; and means for supporting the body, which are adapted to be attached to the ski, with the end of the second rocking lever arm engaging the body supporting means whereby pivoting of the movable body and of the lateral arms around the transverse axis to which the lateral arms are journalled causes relative displacement of the support means and of the second arm of the rocking lever, thereby comprising means for compressing the energy storage means and for varying the value of a release threshold of the binding.

In a particularly preferred embodiment the safety binding includes a ramp on the body supporting means which is attached to the ski. This support ramp may include means for compressing the elastic energy storage means when the second rocking lever arm moves away from the support. The support ramp may further include a projecting lip at its upper portion, which comprises means for limiting movement of the end of the second arm of the rocking lever away from the ski.

In a further embodiment, the pushing element may comprise a slidable piston guided in an orifice of the movable body. Moreover, the pushing element may comprise a rocker device which is journalled with respect to the movable body around an axis which is transverse to the longitudinal extent of the ski. This rocker device may be journalled at one end with respect to the movable body, be connected at its other end to the elastic energy storage means, and be journalled in its middle portion to the rocking lever.

In yet another embodiment the safety binding may include a platform adapted to be attached to the ski, and to which the two lateral arms of the moveable body are journalled around an axis which is transverse to the longitudinal extent of the ski. The platform includes an extension which projects upwardly from an upper surface of the ski, which is inclined towards the rear of the ski, and which comprises a support ramp attached to the ski. The platform and support ramp may be pivotably mounted around a vertical axis substantially perpendicular with respect to the upper surface of the ski, or the platform may be pivotably mounted around the vertical axis while the support ramp is spaced from the platform, is attached to the ski, and extends transversely on both sides of a vertical plane of symmetry with respect the longitudinal extent of the ski. In this latter embodiment the second rocking lever arm is adapted to slidably move along the support ramp and thereby comprises means for varying the compressive force exerted by the elastic energy storage means as the platform pivots. In a particularly preferred embodiment, this support ramp is compressive in the transverse direction on both sides of the vertical plane of symmetry.

BRIEF DESCRIPTION OF THE DRAWINGS

The invention will be better understood with reference to the annexed drawings, given by way of non-limiting example only, ,in which.

DESCRIPTION OF PREFERRED EMBODIMENTS

One of the aims of the present invention is to propose a binding which overcomes the above disadvantages, and which has in particular good qualities both of retention, and of elastic extent, independently of the elastic return.

Another aim of the invention is to propose a binding whose body is carried by journalled arms, which further requires no auxiliary spring to assure the elastic return of the arms in the direction of the ski.

To achieve these aims, the binding according to the invention comprises a movable body connected to the ski by two lateral arms which are journalled at their lower end with respect to the ski around a transverse axis, and a movable jaw which is journalled with respect to the body around a transverse axis. The binding further has energization means comprising elastic energy storage means and a pushing element which pushes a pressure element against a ramp of the jaw.

The binding is characterized in that it comprises further a movable rocking lever which is journalled with respect to the pushing element around a transverse axis. One free end of the rocking lever, constitutes the pressure element pushing against the ramp of the jaw, and the binding further comprises a ramp attached to the ski against which a second free end of the rocking lever pushes, in such a fashion that a pivoting of the body and of the arms around their journal axis to the ski displaces the second free end of the rocking lever along the ramp attached to the ski. This causes a variation of the compression of the energy storage means, and of the intensity of the release threshold of the binding.

Figure 1:
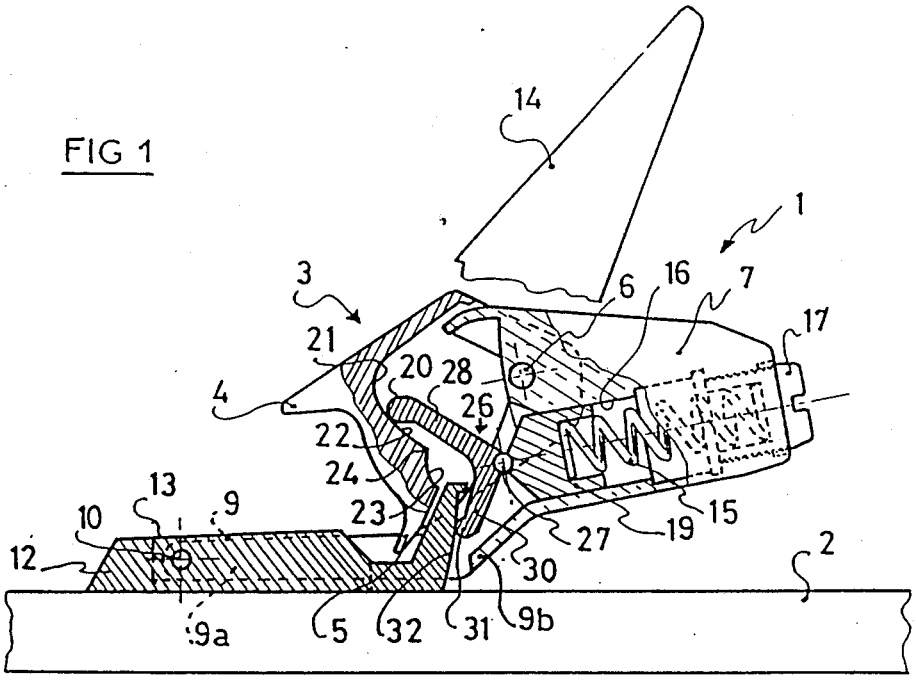
FIG. 1 is a longitudinal cross-sectional view of a binding illustrating the invention in one non-limiting embodiment thereof.
Figure 2:
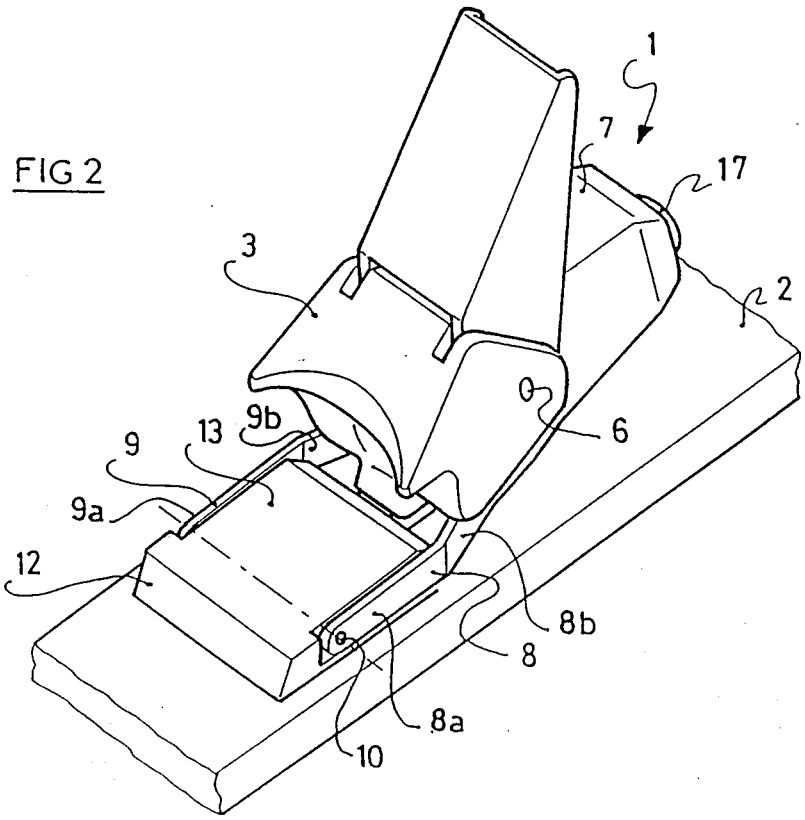
FIG. 2 is a perspective view of the binding of FIG. 1.

FIG. 1 illustrates by way of example of the invention a binding 1 which is attached to the upper surface, of a ski shown schematically as 2. This binding is of the rear binding type, i.e., it is adapted to retain the rear end of a boot but the invention could likewise apply to a front binding.

Binding 1 comprises a jaw 3 which is adapted to retain the end of the boot sole at the level of a sole grip 4, and further comprises a tongue 5 in its lower portion to facilitate insertion of the boot into the binding.

Jaw 3 is movable and is journalled around an axis 6 transverse to the longitudinal direction of the ski with respect to a body 7.

Body 7 is itself carried by two lateral arms 8 and 9 which connect it to the ski, these lateral arms being journalled at their lower portion around a transverse axis 10.

As further shown in the FIGS., the platform for supporting axis 10 is a platform 12 which is attached to the ski directly or by known longitudinal adjustment means, and its upper surface 13 preferably constitutes the foot rest plate on which the sole of the boot is supported in the normal skiing position.

Preferably, platform 12 has two lateral surfaces which are vertical. Furthermore, lateral arms 8 and 9 have, respectively, two segments 8*a*, 9*a* and 8*b*, 9*b*, the first segment 8*a*, 9*a* extending, in the normal practice of skiing, along a lateral surface of platform 12, towards the rear from axis 10, and the second segment 8*b*, 9*b* then rising in the direction of the body. In this manner, the lateral arms 8 and 9 border the lateral surfaces of the platform by passing under the sole of the boot and do not extend laterally beyond the outline of the sole. Furthermore, they are transversely guided by the lateral surfaces of platform 12.

Binding 1 furthermore comprises energization means, whose function is to elastically return the jaw 3 in the direction of the upper surface of the ski, when the vertical forces that the boot exerts on the jaw are less than a predetermined threshold. When the forces exerted exceed this threshold, the energization means allow for a pivoting of the jaw upwardly, in a fashion so as to free the end of the boot.

This pivoting of the jaw upwardly corresponds to the release of the binding, and the bias threshold beyond which this release occurs is currently known as the release threshold.

The energization means elastically connect body 7 and jaw 3. They comprise elastic energy storage means, which are shown in FIG. 1 in the form of a compression spring 15 seated in an orifice 16 of body 7. The initial compression of spring 15 can be adjusted by means of a cap 17 which can be screwed from the exterior into the tapped end of orifice 16.

The energization means can further comprise at the level of the other end of the spring a pushing element which transmits the pressure caused by spring 15 to a pressure element which is thus compressed against a ramp of jaw 3. Referring to FIG. 1, the pushing element is a piston 19 which is mounted sliding in orifice 16 of body 7, at the level of the end of the spring or facing jaw 3.

Piston 19 transmits the pressure of the spring to a pressure element 20 which will be described below. This pressure element 20 is in contact with a ramp 21 of the jaw which, in a known fashion, has a zone 22 of elastic extent, and an opening zone 23, separated by a ridge 24 which corresponds to the release threshold of the binding.

The release of the binding occurs during skiing under the effect of an excessive force exerted by the boot. It can also be caused manually by means of a foot release lever 14 which is activated by the skier, preferably by an action oriented in the direction of the ski. The linkage between the lever and the release mechanism is of a known type and need not be described in further detail.

According to the invention, binding 1 further comprises a movable rocking lever which connects the pushing element 19 to pressure element 20.

FIG. 1 illustrates by way of example a rocking lever 26 which, in longitudinal cross-section, has the general shape of an "L", whose bend is oriented towards spring 15, and whose two arms face jaw 3.

At the level of its bend, rocking lever 26 is connected by a journal to pushing element 19, for example by means of a transverse axis 27. Naturally, any other appropriate journal allowing for movement of the rocking lever in the plane of FIG. 1 may be used.

The upper arm 28 of rocking lever 26 is directed towards ramp 21 of the jaw, and its free end constitutes the pressure element 20 which rests against ramp 21.

The lower arm 30 of rocking lever 26 faces in the direction of platform 12, and its free end has a pressure nose 31 which is in contact with a ramp 32 attached to the ski.

Figure 3:
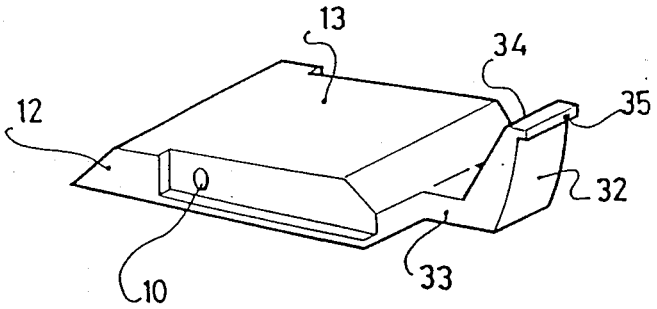
FIG. 3 is a perspective view of the platform on which are journalled the two lateral arms of the binding.

FIG. 3 illustrates a preferred embodiment of this ramp 32. According to this embodiment, platform 12 has towards the rear an extension 33, which extension comprises a portion 34 raised above the upper surface of the ski. It is the surface of this portion 34 oriented towards the rear which constitutes ramp 32 against which pressure nose 31 of rocking lever 26 is compressed by spring 15.

Preferably, in the upper portion of ramp 32 a lip 35 projects, whose role will be described below.

From what has been explained above it will be understood that spring 15 of the energization means is biased in compression on the one hand by the displacement of pressure element 20 of rocking lever 26 along ramp 21 of jaw 3, and is biased on the other hand by the displacement of pressure nose 31 along ramp 32.

The first displacement is caused by a pivoting of jaw 3 with respect to body 7 around axis 6, and the second displacement is caused by the pivoting of body 7 and its lateral arms 8 and 9 around journal axis 10 to the ski.

Binding 1 releases when pressure element 20 crosses ridge 24 of ramp 21 Which corresponds to the release threshold. The force exerted by the boot on the jaw corresponds thus to the intensity of the release threshold of the binding.

Given that the compression of spring 15 is likewise determined by the position of pressure nose 31 on ramp 32, it will be readily understood that displacement of pressure nose 31 along ramp 32 by modifying the compression of the spring likewise modifies the release threshold of the binding. In other terms, the pivoting of body 7 and of its lateral arms 8 and 9 with respect to the ski modifies the release threshold of the binding.

In a preferred manner, ramp 32 is compressive, i.e., a displacement of pressure nose 31 in the direction of a distancing with respect to the upper surface of the ski causes a compression of spring 15. Conversely, a coming together causes a decompression of the spring.

Ramp 32 has any appropriate shape, such as rectilinear or curved, convex or concave. The ramp is positioned on the periphery or on the exterior of a circle whose center is on axis 10 and passes through the bottom of the ramp.

Lip 35 which is positioned in the upper portion of ramp 32 constitutes an abutment for pressure nose 31. This lip thus limits the upward displacement of pressure nose 31 along ramp 32, and thus the upward pivoting of body 7 and of its lateral arms 8 and 9.

Figure 4:
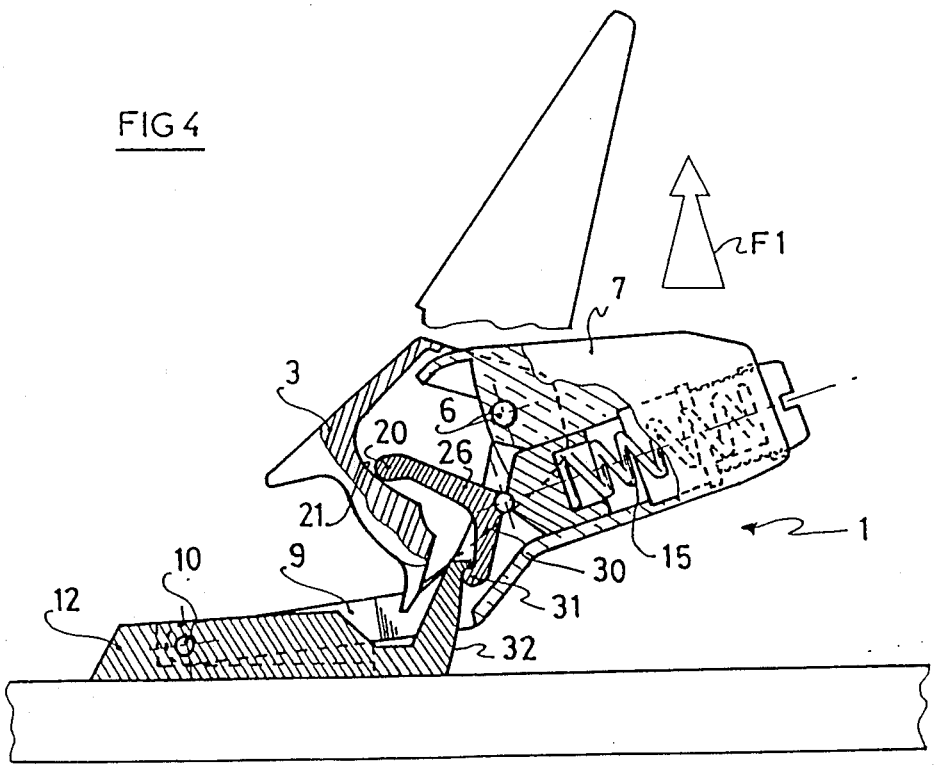
FIG. 4 illustrates the behavior of the binding of FIG. 1 under the effect of a vertical force exerted on the body.
Figure 5:
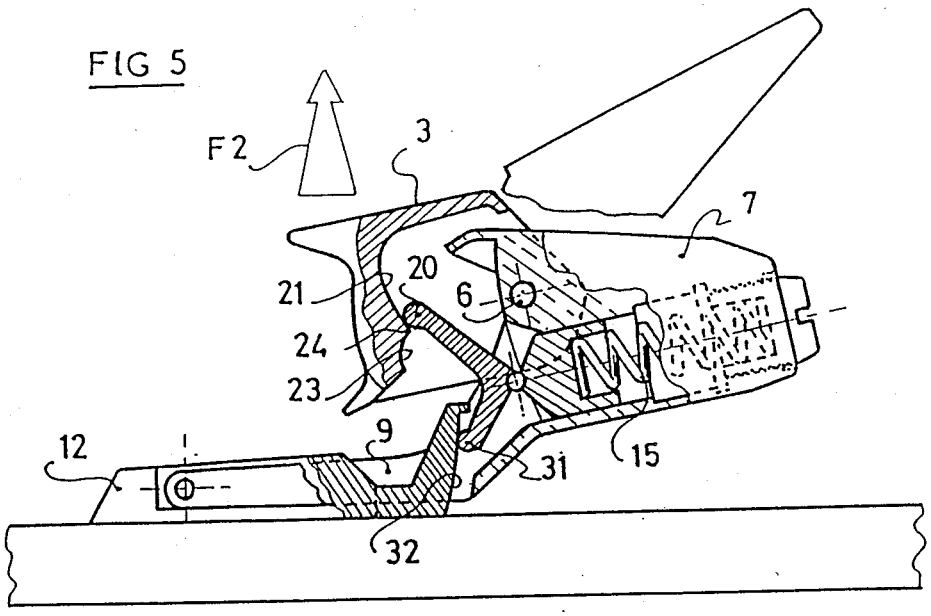
FIG. 5 illustrates the behavior of the binding under the effect or a vertical force exerted on the jaw.

By way of example, FIGS. 4 and 5 illustrate respectively, the binding of FIG. 1 subjected to a vertical force exerted on body 7, and a vertical force exerted on jaw 3.

Figure 6:
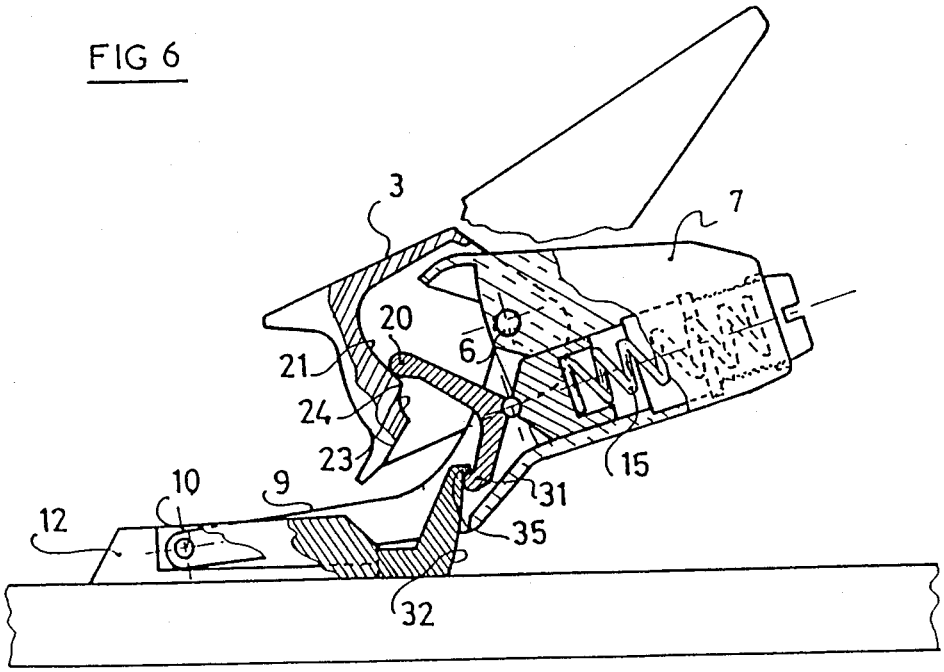
FIG. 6 illustrates the behavior of the binding under the effect of a combined force exerted on the body and on the jaw.

These forces have purposely been isolated in the FIGS. to better illustrate the operation of the binding. It is self-evident that during skiing these forces are combined as is illustrated in FIG. 6.

Referring to FIG. 4, binding 1 is subjected to a vertical force towards the top shown schematically as F1. Under the effect of this force, body 7 and lateral arms 8 and 9 pivot around their journal axis 10 on the ski. On the other hand, jaw 3 undergoes no relative movement with respect to body 7.

The upward pivoting of body 7 and of lateral arms 8 and 9 causes a displacement of pressure nose 31 of lower arm 30 of rocking lever 26 along ramp 32. Conversely, pressure element 20 of rocking lever 26 does not move substantially with respect to ramp 21 of the jaw.

Ramp 32 being compressive, such a displacement causes a compression of spring 15, which likewise increases the release threshold of the binding.

From the position shown in FIG. 4, body 7 is elastically returned in the direction of the upper surface of the ski by spring 15 which decompresses. It is thus not necessary in the present case to use auxiliary springs to assure the elastic return function of the body in the direction of the ski.

It can be considered in this case that the compression of the spring is caused only by the displacement of pressure nose 31 of rocking lever 26 along ramp 32 which is attached to the ski.

FIG. 5 illustrates binding 1, whose jaw 3 is subjected to a vertical force, directed upwardly, shown schematically as F2. It is supposed furthermore that under the effect of this vertical force, body 7 and arms 8 and 9 remain in their lowered position, resting against the ski.

Force F2 causes an upward pivoting of jaw 3 with respect to body 7, around journal axis 6, which causes further a displacement of pressure element 20 along ramp 21 of jaw 3.

It is known that ramp 21 is compressive in its elastic extent zone 22. The upward pivoting of jaw 3 thus causes a compression of spring 15. In a known fashion, as long as pressure element 20 is in contact with the elastic extent zone 22 of ramp 21, jaw 3 is elastically returned in the direction of the upper surface of ski 2. On the other hand, when force F2 exceeds the intensity of the release threshold of the binding, pressure element 20 crosses ridge 24 and consequently follows opening zone 23, which is itself decompressive. Jaw 3 thus tends to pivot upwardly and to remain in this position, allowing for the liberation of the end of the boot.

In the case of FIG. 5, it can be considered that the compression of spring 15 is caused only by pressure element 20 of rocking lever 26 which follows ramp 21 of jaw 3.

FIG. 6 illustrates binding 1 under the effect of a combined vertical force which exerts itself at the same time on both jaw 3 and body 7. Such a configuration generally corresponds to what occurs during skiing, where the force exerted by the boot on jaw 3 may be broken down into a force such as F2 between jaw 3 and body 7, and a force such as F1 between body 7 and ski 2.

Thus, FIG. 6 shows jaw 3 which has pivoted with respect to body 7 around transverse axis 6, and body 7 which has pivoted with respect to ski 2 around transverse axis 10.

Spring 15 is thus compressed on the one hand by the displacement of pressure element 20 along ramp 21 of jaw 3, and on the other hand by the displacement of pressure nose 31 along ramp 32.

As has been previously described, the displacement of pressure nose 31 along ramp 32, by causing additional compression at the level of the spring, increases further the intensity of the release threshold of the binding.

Figure 7:
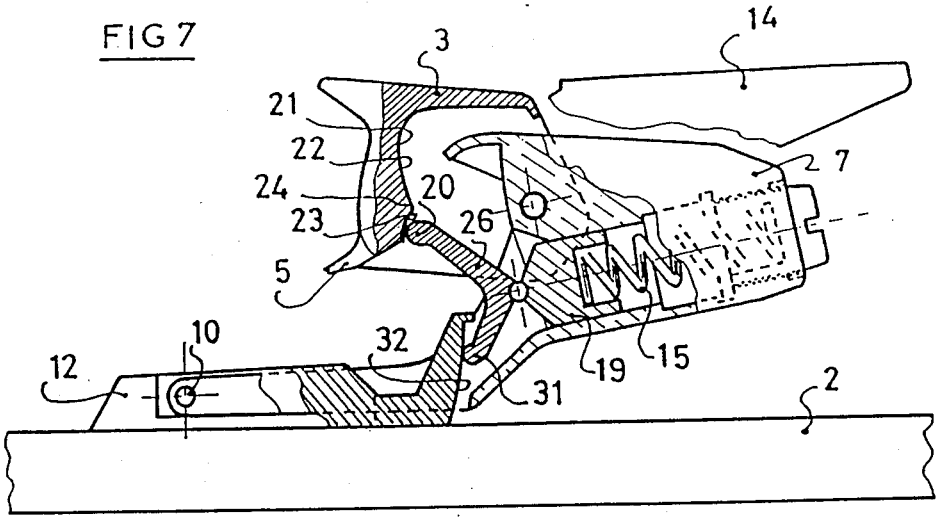
FIG. 7 illustrates the binding of FIG. 1 with the boot removed.

FIG. 7 illustrates the binding of FIG. 1 in the released position. This position is achieved by a release of the binding during skiing and the liberation of the boot, by an excessive force, or by a manual release of the binding by means of the boot release lever 14.

In the position where the boot is removed, pressure element 20 is in contact with opening zone 23 of ramp 21 of jaw 3. On the other hand, by virtue of the fact that body 7 and lateral arms 8 and 9 are elastically returned in the direction of the ski, pressure nose 31 is at the bottom of ramp 32.

As a result, in this position, it is only ramp 21 of jaw 3 which intervenes in the compression of spring 15, ramp 32 itself having a substantially negligible influence.

Insertion of the boot consists, for the skier, of making pressure element 20 cross ridge 24 by exerting a downward pressure on boot insertion tongue 5 of jaw 3, by means of the heel of the boot (in the case of rear binding).

By this maneuver, pressure element 20 crosses in the opposite direction ridge 24 which corresponds to the release threshold. Being given that the release threshold has a minimal value, because pressure nose 31 is at the bottom of ramp 32, the energy which the skier must furnish to reinsert his boot into the binding is reduced, compared to that which he must furnish for a binding whose body is attached to the ski.

In other terms, the boot removal circuit is different from the release circuit during skiing because one reduces to the minimum the influence of ramp 32.

This is true as well for a manual removal of the boot by means of lever 14. In effect, a manual removal of the boot is caused by a downward pivoting of lever 14, the binding being found in the state in which it is shown in FIG. 1. Such a maneuver of the boot removal lever tends to press body 7 and arms 8 and 9 against the surface of the ski, and as a result, to maintain pressure nose 31 of rocking lever 26 at the bottom of ramp 32. As a result, the energy necessary to release the binding, i.e., to make pressure element 20 cross ridge 24 which corresponds to the release threshold, is reduced to its minimum value, given that ramp 32 does not cause additional compression of spring 15, as is the case during skiing.

In this case as well, the boot removal energization circuit is different from the release energization circuit of the binding during skiing.

The binding of FIG. 1 has good elastic extent qualities, given that during skiing, this elastic extent is taken at the same time on both the elastic extent zone 22 of ramp 21 and on ramp 32.

These elastic extent and foot retention qualities are obtained independently of the elastic return. Thus, the binding in FIG. 1 can be equipped with retraction means which are adapted to assure good elastic retraction qualities, and not to compensate for an insufficient elastic extent or an insufficient foot retention.

Binding 1 furthermore has good foot retention qualities because it has a jaw journalled with respect to a body.

One of ordinary skill in the art is capable of determining the different parameters such as the shape of ramp 32, the relative length of upper arm 28 and lower arm 30 of rocking lever 26, the length of arms 8 and 9, and so on.

Figure 8:
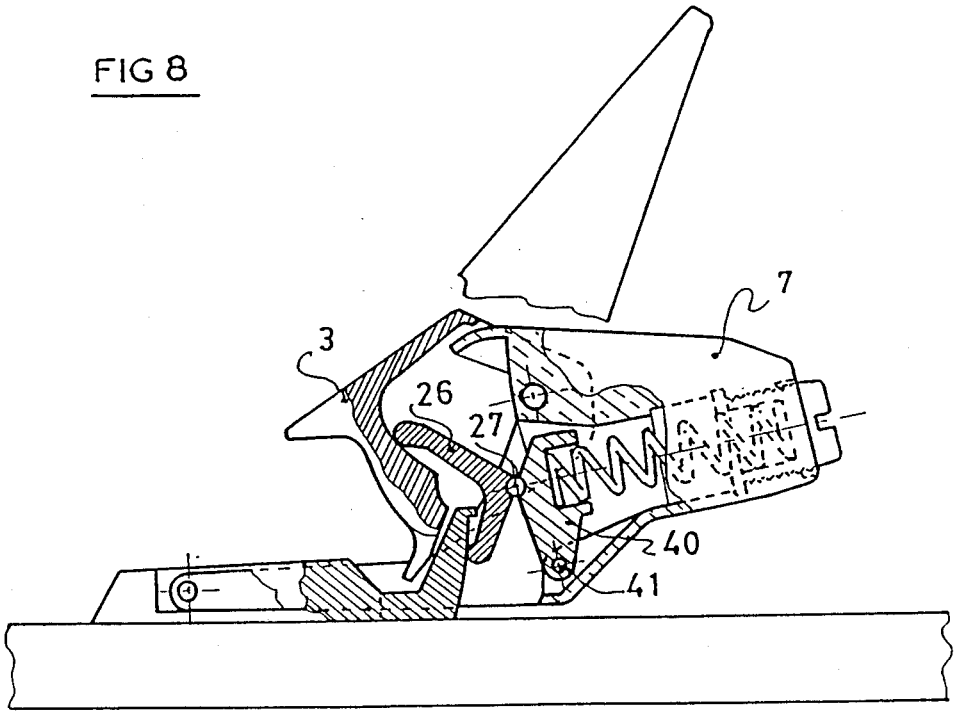
FIGS. 8–12 each illustrate an alternative embodiment of the binding of FIG. 1.

FIG. 8 illustrates an alternative embodiment of the invention in which piston 19 which constitutes the pressure element is replaced by a rocker 40 which is journalled with respect to body 7 around a transverse axis 41. Rocking lever 26 itself remains connected by journal to rocker 40. The operation of this binding is similar to that of the preceding binding except for the fact that the linkage between rocking lever 26 and the pressure element, i.e., axis 27, no longer follows a linear trajectory, but a circular trajectory centered on journal axis 41 of rocker 40.

Figure 9:
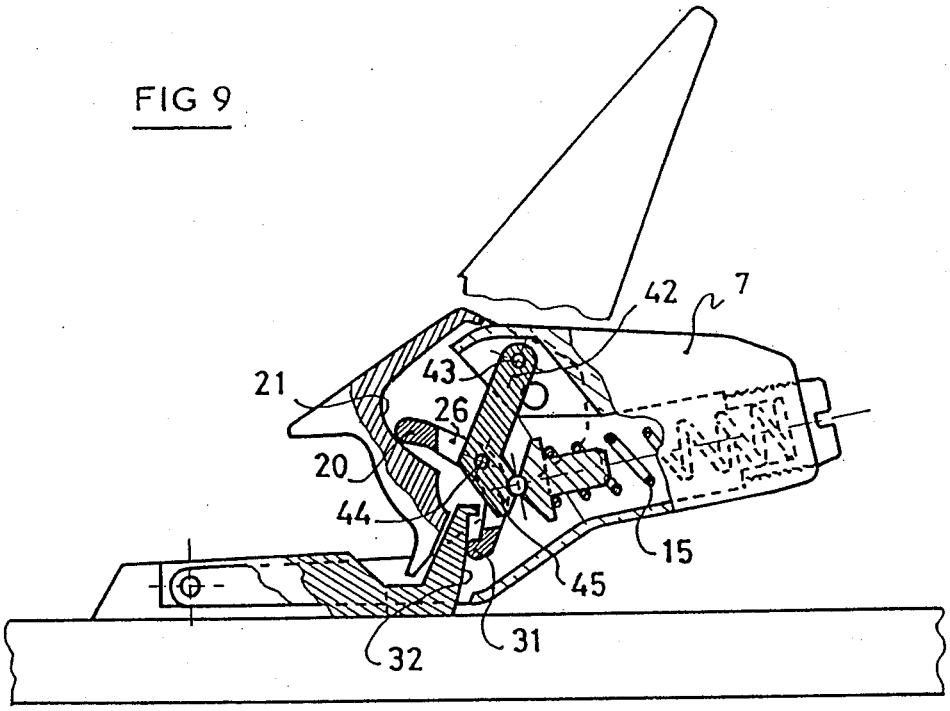

An alternative embodiment of FIG. 9 likewise comprises a rocker 42 which constitutes the pressure element, and which is journalled with respect to the body around an axis 43. In this case, the journal between rocking lever 26 and rocker 42 is positioned between journal axis 43 of rocker 42 with respect to body 7, and the other end 45 of rocker 42 which receives the end of spring 15. In this fashion, the movement of this end 45 of rocker 42 is amplified with respect to the movement of journal 44 of rocking lever 26 to rocker 42.

Likewise, in the construction thus adopted, journal 44 of rocking lever 26 to rocker 42 is brought towards pressure element 20 and spaced from pressure nose 31. This makes it possible to modify the relative influence of ramps 21 and 32 on the compression of spring 15.

Figure 10:
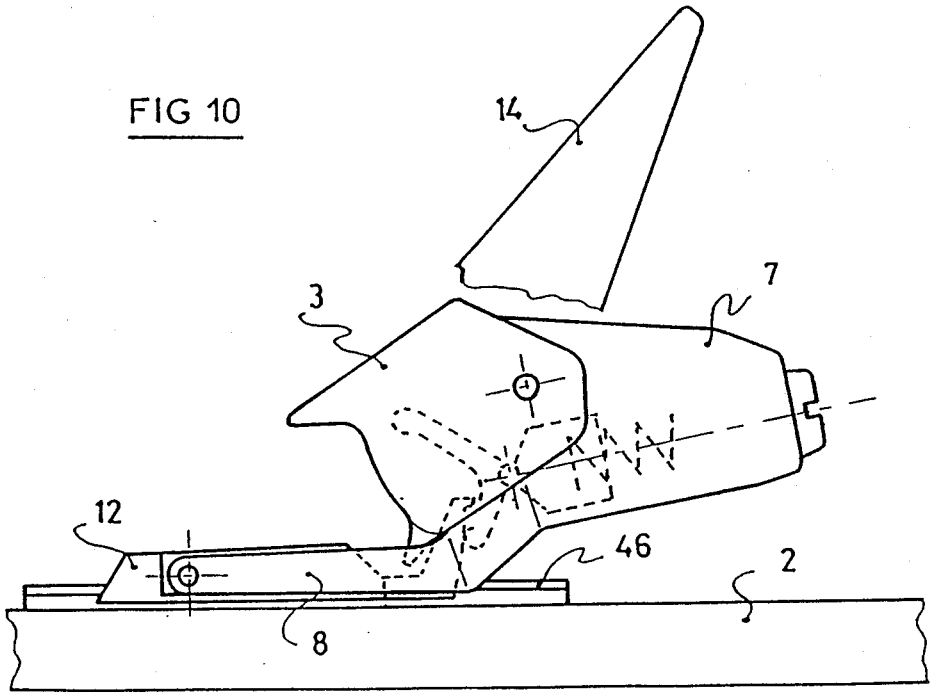

In the embodiment shown in FIG. 10, binding 1 further comprises elastic return means of a conventional type. These means comprise for example a longitudinal slide 46, along the length of which can slide platform 12, and return springs which elastically return platform 12 towards the other binding, and which are for example positioned within this platform.

It must be noted that through a return force, ramp 32 is displaced along the longitudinal direction of the ski without relative movement with respect to the platform of axis 10, i.e., in the present case, of platform 12.

Figure 11:
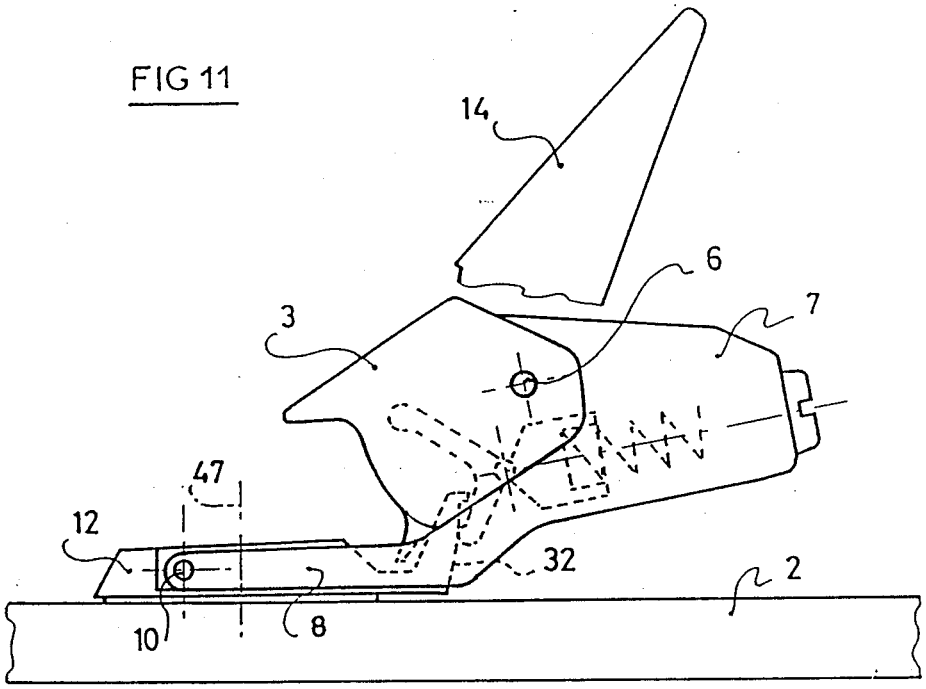

In the alternate embodiment of FIG. 11, platform 12 is pivotable around an axis shown schematically at 47, perpendicular to the upper surface of ski 2. In the course of the rotation of platform 12, ramp 32 remains connected to the platform and pivots with it around axis 47.

Figure 12:
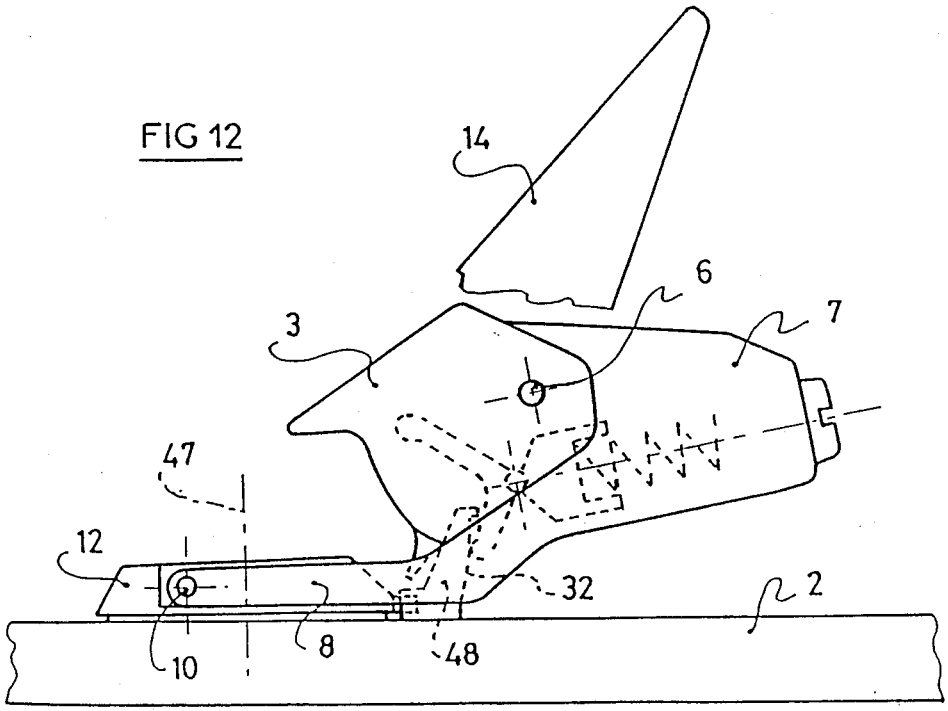

In the alternate embodiment of FIG. 12, platform 12 is likewise pivotable around an axis 47 perpendicular to the upper surface of the ski. However, ramp 32 is carried by an element 48 which projects and which is attached to the ski. In this case, ramp 32 acts in the vertical direction as a result of a pivoting of jaw 3 or of body 7 around their respective axes 6 and 10. It acts also in the transverse direction, on both sides of the vertical plane of symmetry 49 of the ski (shown in FIG. 13), as a result of pivoting of platform 12, of body 7, and of jaw 3 around axis 47.

Figure 13:
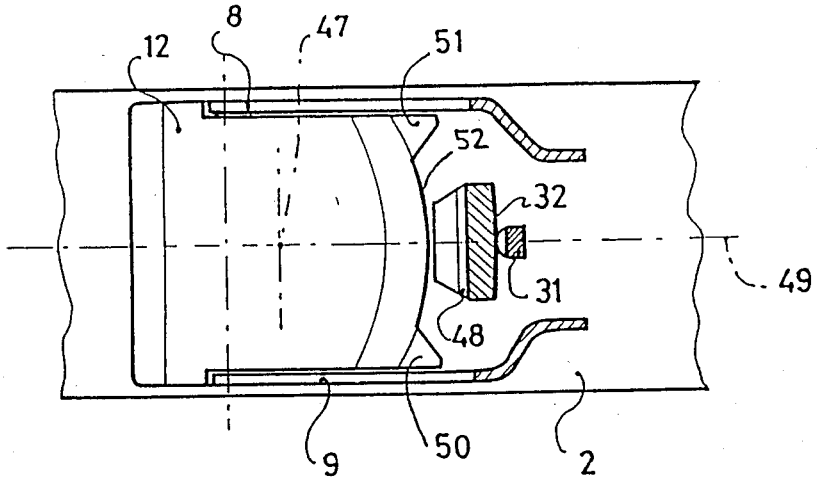
FIG. 13 is a partial top view in cross-section of FIG. 12.

Preferably, in the transverse direction, ramp 32 is compressive, i.e., a spacing of the pressure nose 31 with respect to the position which it occupies in FIG. 13, on one side or the other of plane 49, causes a compression of the energization spring. As a result, ramp 32 assures, by its transverse component, an elastic return of the binding into a centered position on the ski.

Furthermore, preferably rear edge 52 of platform 12 is substantially rounded, and this edge has at each end an abutment 50, 51 in projection. Each of these abutments 50, 51 limits the lateral pivoting of platform 12, on each side of plane 49, by being supported against the projecting element 48. Naturally, ramp 32 is transversely dimensioned such that pressure nose 31 remains in contact with it over the entire lateral pivotal amplitude of platform 12.

Figure 14:
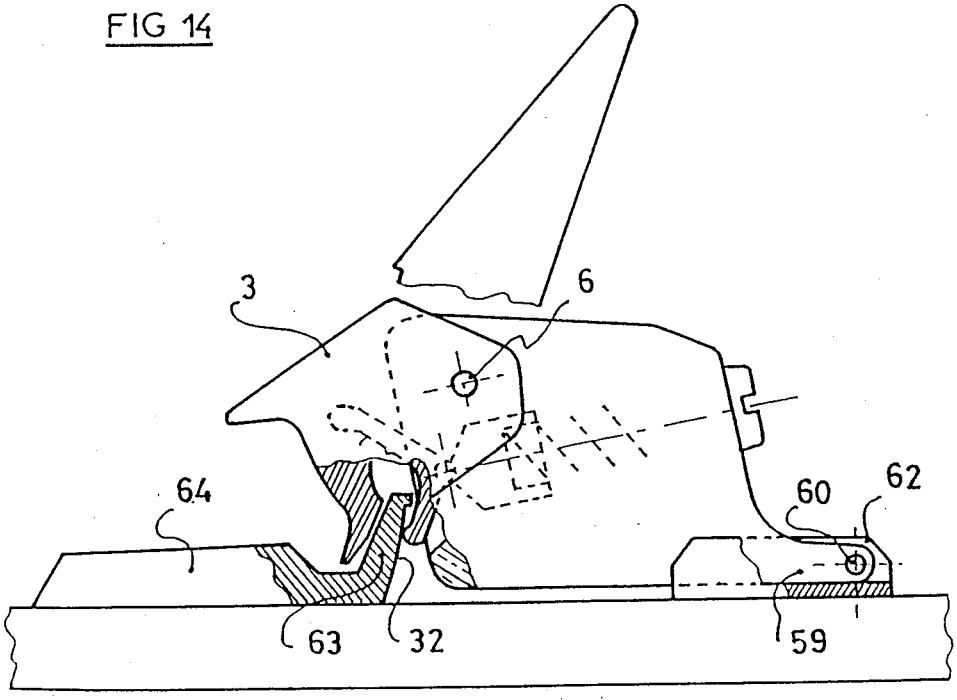
FIG. 14 is an alternative embodiment of FIG. 1 with a reverse orientation of the lateral arms.

FIG. 14 shows an alternative embodiment in which platform 62, carrying journal axis 60 of lateral arm 59 and of the corresponding lateral arm on the opposite side of platform 62, is positioned at the rear of jaw 3.

Projecting element 63 which carries ramp 32 is thus situated in front of platform 62, and the shape of ramp 32 takes into account the displacement of the journal axis of the arms to the ski, i.e., that it is positioned on the periphery or the interior of a circle centered on axis 60 and passing through the bottom of the ramp.

If desired, as shown in FIG. 14, the projecting element 63 extends towards the front in the form of a block 64, situated in front of the jaw, whose upper surface serves as a foot rest plate for the boot.

Figure 15:
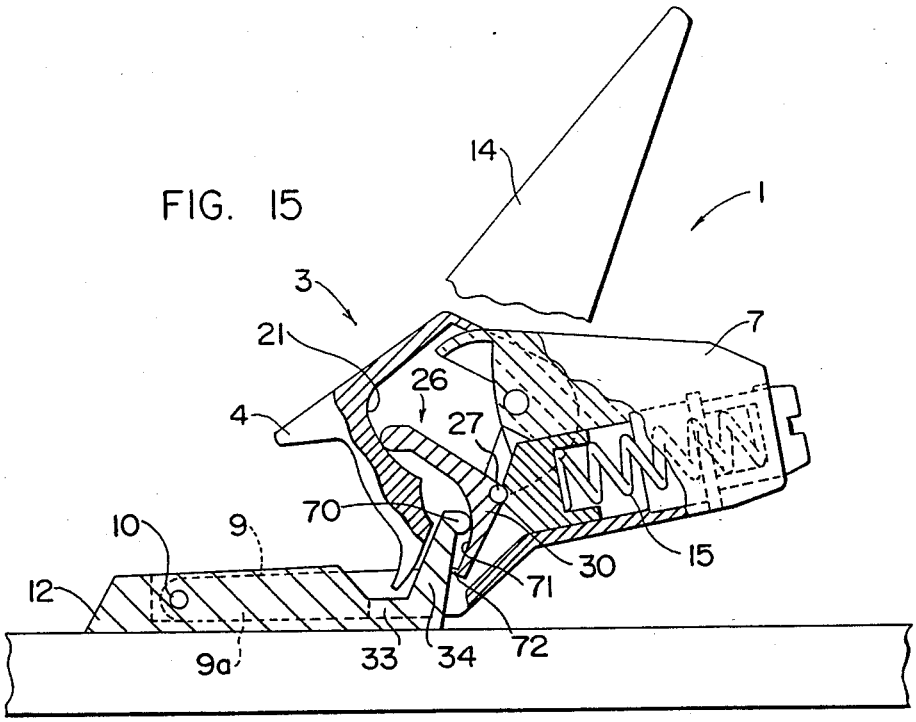
FIG. 15 is an alternative embodiment of FIG. 1, showing a variation on the ramp and of the pressure nose.

FIG. 15 illustrates an alternative embodiment of the apparatus as shown in FIG. 1, showing a variation with respect to ramp 32 and pressure nose 31 of rocking lever 26.

In the embodiment as shown in FIG. 15, platform 12 has in the upper portion of its rear extension 33 a pressure nose 70. In addition, the lower arm 30 of rocking lever 26 has a ramp 71 positioned on the side facing pressure nose 70. Ramp 71 is compressed against pressure nose 70 by the action of spring 15, and is traversed by pressure nose 70 when body 7 and arms 8 and 9 pivot around axis 10.

Preferably, ramp 71 has in its lower portion a projecting lip 72.

Figure 16:
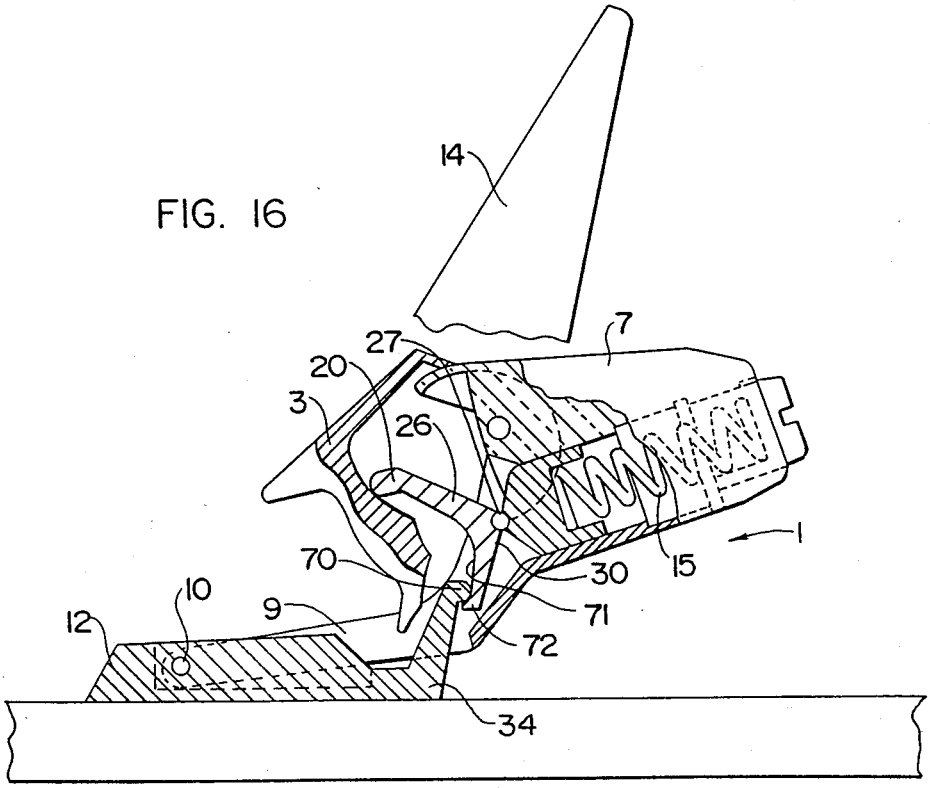
FIG. 16 illustrates the operation of the embodiment depicted in FIG. 15.

When the body and the arms pivot around axis 10, as shown in FIG. 16, the return force of spring 15 is varied by the displacement of pressure nose 70 against ramp 71.

The displacement of pressure nose 70 against ramp 71 causes, on the one hand, the pivoting of rocking lever 26 around axis 27 which is due to the shape of ramp 71, and, on the other hand, a variation of the arm of the lever at the level of arm 30 of rocking lever 26, i.e., a variation in the distance between axis 27 and the contact zone of pressure nose 70 against ramp 71.

FIG. 16 illustrates body 7 and arms 8 and 9 in the upwardly pivoted position around axis 10.

Pressure nose 70 is then positioned at the bottom of ramp 71, and the lever arm at the level of the arm 30 of rocking lever 26 is at its uppermost extent.

Lip 72 thus limits the upward pivoting of the body and of the arms.

The apparatus shown in FIGS. 15 and 16 otherwise has an operation identical to that of the apparatus shown in FIG. 1, as regards pivoting of the jaw with respect to the body.

Naturally, the above description is given by way of non-limiting example only in which particular means, materials and embodiments are disclosed. It is to be understood, however, that the invention is not limited to the specifics disclosed and extends to all equivalents within the scope of the claims.

What is claimed is:

1. A safety binding adapted to releasably hold a boot on a ski, said boot comprising:

(a) means for securing the binding to said ski;

(b) a movable body having spaced lateral arms pivotably connected to said securing means along a first axis which is substantially transverse to the longitudinal extent of a ski on which said binding is adapted to be positioned;

(c) a jaw pivotably connected to said body along a second axis which his substantially transverse to the longitudinal extent of said ski, said jaw comprising means for engaging and holding a portion of said boot on said securing means when said boot is positioned on said securing means and said binding is attached to said ski; and (d) means for biasing said jaw and said body toward said ski and for increasing the release threshold of said binding in response to upward movement of said body, said biasing force increasing means including a rocking lever.

2. The safety binding as defined by claim 1, wherein said securing means comprise a platform having a lower surface adapted to abut the upper surface of said ski, an upper surface adapted to support the sole of said boot, and two lateral surfaces adapted to receive said spaced lateral arms, said platform further comprising a projection extending upwardly from the upper surface of said ski, said projection further comprising a ramp of said platform, and said ramp comprising a projecting lip at its upper portion which comprises means for limiting movement of said safety binding away from said ski.

3. The safety binding as defined by claim 2, wherein said lateral surfaces are substantially parallel to each other and to the longitudinal extent of said ski.

4. The safety binding as defined by claim 1, wherein each of said spaced lateral arms comprises a first portion, connected at a free end of said arm to said first axis and extending adjacent said lateral surface towards said moveable body along a direction which is substantially parallel to the longitudinal extent of said ski, and a second portion extending from said first portion, said second portion being adapted to project upwardly from the upper surface of said ski toward said binding.

5. The safety binding as defined by claim 4, wherein the spacing between said lateral arms is less than or equal to the width of a sole of aid boot adapted to be positioned on said ski.

6. The safety binding as defined by claim 1, wherein said jaw comprises an upper extension adapted to engage the upper surface of the sole of said boot, a lower extension adapted to engage a bottom surface of the sole of said boot, and a ramp located on an inner surface of said jaw, said jaw ramp further comprising an upper compressive zone, a lower opening zone adjacent to said upper zone, and a ridge positioned between said zones.

7. The safety binding defined by claim 6, wherein said biasing means comprises elastic storage means, and wherein said upper compressive zone comprises means for compressing said elastic energy storage means when said jaw pivots upwardly away from said ski, whereby said upper compressive zone is biased with increasing force and said jaw is increasingly biased back towards said ski.

8. The safety binding as defined by claim 7, wherein said lower opening zone comprises means for decompressing said elastic energy storage means and for biasing said jaw upwardly from said ski.

9. The safety binding as defined by claim 1, wherein said biasing means comprise elastic energy storage means, a pushing element in contact with said elastic energy storage means, and means for transferring elastic energy from said pushing element to a ramp located on an inner surface of said jaw.

10. The safety binding as defined by claim 9, further comprising means for adjusting the amount of elastic energy stored in said elastic energy storage means.

11. The safety binding as defined by claim 10 wherein said adjusting means comprise a screw which compresses said elastic energy storage means when said screw rotates in a first direction and which decompresses said elastic energy storage means when said screw rotates in a second direction.

12. The safety binding as defined by claim 9, wherein said energy transferring means include said rocking lever, said rocking lever having an intermediate portion which is in contact with said pushing element, and said rocking lever further comprising an upper arm having an end which comprises a pressure element and which slideably contacts said jaw ramp.

13. The safety binding as defined by claim 12, wherein said rocking lever further comprises a lower arm having an end which comprises a pressure nose and which slideably contacts a ramp on said securing means.

14. The safety binding as defined by claim 12, wherein said securing means comprise a platform which includes a projection extending upwardly from the upper surface of said ski, said projection having at its upper end a pressure nose, and wherein said rocking lever further comprises a lower arm having a ramp slideably contacting said pressure nose of said projection.

15. The safety binding as defined by claim 14, wherein said rocking lever ramp comprises means for compressing said elastic energy storage means when said body pivots upwardly away from said ski.

16. The safety binding as defined by claim 15, wherein said rocking lever ramp comprises a projecting lip at its lower portion which comprises means for limiting movement of said safety binding away from said ski.

17. The safety binding as defined by claim 9, wherein said pushing element comprises a rocker arm pivotably connected to said body along an axis which is substantially transverse to the longitudinal extent of said ski.

18. The safety binding as defined by claim 17, wherein said energy transferring means include said rocking lever, said rocking lever having a middle portion which contacts said rocker arm, and said rocking lever further comprising an upper arm having an end which comprises a pressure element and which slidably contacts said jaw ramp.

19. The safety binding as defined by claim 18, wherein said rocker arm comprises first and second ends, said substantially transverse axis pivotably connecting said rocker arm to said body is located at said first end of said rocker arm, said second end of said rocker arm is in contact with said elastic energy storage means, and an intermediate rocker arm portion between said first end and said second end is in contact with said rocking lever.

20. The safety binding as defined by claim 1, further comprising a manual release lever which comprises means for disengaging a boot from said binding when said boot is positioned on said ski.

21. The safety binding as defined by claim 1, wherein said securing means are adapted to be slidably connected to said ski along at least a portion of the longitudinal extent of said ski, said binding further comprising means for elastically returning said binding along said ski in one predetermined direction.

22. The safety binding as defined by claim 21, wherein said binding return means comprise at least one spring.

23. The safety binding as defined by claim 1, wherein said securing means are adapted to be pivotably connected about a vertical axis which is substantially perpendicular to the upper surface of said ski.

24. The safety binding as defined by claim 23, wherein said securing means comprise a platform having a lower surface adapted to abut an upper surface of said ski, an upper surface adapted to support the sole of said boot, and two lateral surfaces adapted to receive said spaced lateral arms, said safety binding further comprising an extension having a ramp which is adapted to be attached to the upper surface of said ski in spaced relationship from said platform.

25. The safety binding as defined by claim 24, wherein said extension and said platform are substantially positioned on opposite sides of said body.

26. The safety binding as defined by claim 24, further comprising means for limiting the extent of pivotable movement of said platform.

27. The safety binding as defined by claim 26, wherein said limiting means comprise first and second spaced projections attached to respective edges of said platform, and an abutment adapted to be attached to an upper surface of said ski in spaced relationship to said platform, wherein said projections are adapted to engage said abutment when said platform pivots around said vertical axis.

28. The safety binding as defined by claim 24, further comprising means for biasing said platform towards a central position with respect to the longitudinal extent of said ski.

29. The safety binding as defined by claim 28, wherein said means for biasing said platform towards a central position comprise means for compressing said elastic energy storage means when said platform pivots away from a central position.

30. The safety binding as defined by claim 1, wherein said securing means are attached to an upper ski surface.

31. A platform adapted to connect a safety binding to a ski, said platform comprising a lower surface adapted to be attached to said ski, opposed side recesses adapted to be attached to said binding, and an inclined ramp extending upwardly beyond an upper horizontal support surface of said platform, said ramp comprising means for slideably engaging a device for biasing said safety binding towards said ski, wherein said opposed side recesses extend along a major portion of said platform in the direction of the longitudinal extent of said ski, said platform further comprising a bore which extends through said platform transversely with respect to the longitudinal extent of said ski and which emerges from either side of said platform within each of said opposed side recesses, said bore comprising means for pivotably connecting said platform to two lateral arms adapted to be connected to said binding.

32. The platform as defined by claim 31, wherein said ramp comprises a projecting lip at its upper portion which comprises means for limiting movement of said safety binding away from said ski.

33. The platform as defined by claim 31, wherein said platform is adapted to be pivotably connected to the upper surface of said ski along a vertical axis substantially perpendicular to the upper surface of said ski, said platform further comprising means for limiting the extent of pivotable movement of said platform.

34. The platform as defined by claim 31, wherein said limiting means comprises first and second spaced projections attached to respective edges of said platform and an abutment adapted to be attached to an upper surface of said ski in spaced relation to said platform, wherein said projections are adapted to engage said platform when said platform pivots around said vertical axis.

35. A safety binding for a ski boot adapted to retain one end of the boot and to free said end of said boot when it exerts on the binding a force exceeding a predetermined threshold, said binding comprising:

(a) a movable body adapted to be connected to said ski by two lateral arms which are journalled at their lower end around a first axis which is transverse to the longitudinal extent of said ski;

(b) a movable jaw adapted to retain the end of said boot, said jaw being journalled to said body around a second axis transverse to the longitudinal extent of said ski, said jaw comprising a ramp located on an inner surface of said jaw;

(c) energization means, comprising elastic energy storage means and a pushing element which pushes a pressure element against said jaw ramp, further comprising a rocking lever having first and second arms, said rocking lever being journalled to said pushing element, wherein the end of said first rocking lever arm comprises a pressure element slideably contacting said jaw ramp;

(d) means for supporting said body, which support means are adapted to be attached to said ski, said second arm of said second rocking lever arm engaging said support means, wherein pivoting of said movable body and of said lateral arms around said first axis causes relative displacement of said support means and of the end of said second arm of said rocking lever, thereby comprising means for compressing said elastic energy storage means and for varying the value of a release threshold of said binding.

36. The safety binding as defined by claim 35, wherein said support means comprise a ramp on said support means which is attached to said ski.

37. The safety binding as defined by claim 36, wherein said support ramp comprises a projecting lip at its upper portion, which comprises means for limiting movement of said safety binding away from said ski.

38. The safety binding as defined by claim 37, wherein said support means further comprise a platform adapted to be attached to said ski, and to which said two lateral arms are adapted to be pivotably connected around said first axis, said platform comprising an extension which projects upwardly from an upper surface of said ski, said extension being inclined towards the rear of said ski and including said support ramp.

39. The safety binding as defined by claim 38, wherein said platform and said support ramp are piVotably mounted around a vertical axis which is substantially perpendicular to the upper surface of said ski.

40. The safety binding as defined by claim 38, wherein said platform is pivotably mounted around a vertical axis which is substantially perpendicular to the upper surface of said ski and said support ramp is attached to said ski and extends transversely on both sides of a vertical plane of symmetry with respect to the longitudinal extent of said ski, and further wherein the end of said second rocking lever arm is adapted to slideably move along said support ramp and thereby comprises means for varying the compressive force exerted by said elastic energy storage means.

41. The safety binding as defined by claim 40, wherein said support ramp is compressive in the transverse direction on both sides of said vertical plane of symmetry.

42. The safety binding as defined by claim 36, wherein said support means further comprise means for compressing said elastic energy storage means when said second rocking lever arm moves away from said support.

43. The safety binding as defined by claim 42, wherein said pushing element comprises a slidable piston guided in an orifice of said movable body.

44. The safety binding as defined by claim 42, wherein said pushing element comprises a rocker device which is adapted to be pivotably connected to said movable body around a third axis which is transverse to the longitudinal extent of said ski.

45. The safety binding as defined by claim 44, wherein said rocker device comprises a first end, a second end, and an intermediate portion between said first and second ends, said third axis being located substantially at said first end, said second end being in contact with said elastic energy storage means, and said intermediate portion being adapted to be pivotably connected to an intermediate portion of said rocking lever.

46. The safety binding as defined by claim 35, wherein said pushing element comprises a slidable piston guided in an orifice of said movable body.

47. The safety binding as defined by claim 35, wherein said pushing element comprises a rocker device which is journalled with respect to said movable body around a third axis which is transverse to the longitudinal extent of said ski.

48. The safety binding as defined by claim 47, wherein said rocker device comprises a first end, a second end, and an intermediate portion between said first and second ends, said third axis being located substantially at said first end, said second end being in contact with said elastic energy storage means, and said intermediate portion being adapted to be pivotably connected to an intermediate portion of said rocking lever.

49. The safety binding as defined by claim 48, wherein said support means further comprise a platform adapted to be attached to said ski, and to which said two lateral arms are adapted to be pivotably connected around said first axis, said platform comprising an extension which projects upwardly from an upper surface of said ski, said extension being inclined towards the rear of said ski and comprising a support ramp.

50. The safety binding as defined by claim 49, wherein said platform and said support ramp are adapted to be pivotably mounted around a vertical axis which is substantially perpendicular to the upper surface of said ski.

51. The safety binding as defined by claim 49, wherein said platform is adapted to be pivotably mounted around a vertical axis which is substantially perpendicular to the upper surface of said ski and said support ramp is attached to said ski and extends transversely on both sides of a vertical plane of symmetry with respect to the longitudinal extent of said ski, and further wherein said second rocking lever arm is adapted to slideably move along said support ramp and thereby comprises means for varying the compressive force exerted by said elastic energy storage means.

52. The safety binding as defined by claim 51, wherein said support ramp is compressive in the transverse direction on both sides of said vertical plane of symmetry.

53. The safety binding as defined by claim 35, further comprising a platform adapted to be attached to said ski, and to which said two lateral arms are adapted to be pivotably connected around said first axis, said platform comprising an extension which projects upwardly from an upper surface of said ski, said extension being inclined towards the rear of said ski and comprising a support ramp.

54. The safety binding as defined by claim 63, wherein said platform and said support ramp are adapted to be pivotably mounted around a vertical axis which is substantially perpendicular to the upper surface of said ski.

55. The safety binding as defined by claim 53, wherein said platform is pivotably mounted around a vertical axis which is substantially perpendicular to the upper surface of said ski and said support ramp is attached to said ski and extends transversely on both sides of a vertical plane of symmetry with respect to the longitudinal extent of said ski, and further wherein said second rocking lever arm is adapted to slideably move along said support ramp and thereby comprises means for varying the compressive force exerted by said elastic energy storage means.

56. The safety binding as defined by claim 55, wherein said support ramp is compressive in the transverse direction on both sides of said vertical plane of symmetry.

57. A safety binding adapted to releasably hold a boot on a ski, said binding comprising:

(a) means for securing the binding to said ski;

(b) a movable body having spaced lateral arms pivotably connected to said securing means along a first axis which is substantially transverse to the longitudinal extent of a ski on which said binding is adapted to be positioned;

(c) a jaw pivotably connected to said body along a second axis which is substantially transverse to the longitudinal extent of said ski, said jaw comprising means for engaging and holding a portion of said boot on said securing means when said boot is positioned on said securing means and said binding is attached to said ski; and (d) means for biasing said jaw and said body towards said ski and for increasing the biasing force exerted by the biasing means on said jaw in response to upward movement of said body, said biasing force increasing means including a rocking lever which is operatively associated at least between the jaw and the means for securing the binding to said ski.

58. A safety binding adapted to releasably hold an end of a boot on a ski, said binding comprising:

(a) a base for mounting said binding to said ski;

(b) a body;

(c) means for mounting said body for movement relative to said base;

(d) a jaw including means for engaging a portion of said end of said boot for retaining said end of said boot on said ski;

(e) means for mounting said jaw on said body of said binding for movement relative to said body and for movement relative to said ski;

(f) means for biasing said jaw towards said ski;

(g) means for biasing said body towards said ski;

(h) a rocking lever including a first portion in operative association with said jaw and said body, and a second portion in operative association with said base and said body, wherein said means for biasing said jaw towards said ski comprises said first portion of said rocking lever, and wherein said means for biasing said body towards said ski comprises said second portion of said rocking lever, wherein said means for biasing said jaw and said means for biasing said body towards said ski further comprise means for increasing the release threshold of said binding in response to upward movement of said body.

59. The binding of claim 58 wherein said means for biasing said jaw towards said ski and said means for biasing said body towards said ski, including said rocking lever, are configured and arranged such that the force required to release said boot from said binding in a lowered position of said body is less than the force required to release said boot from said binding in a position of said body raised with respect to said lowered position.

60. A safety binding adapted to releasably hold an end of a boot on a ski, said binding comprising:

(a) a base for mounting said binding to said ski, wherein said base comprises a platform to be mounted upon a ski and having an upper surface to support said boot, said platform further comprising a projection extending upwardly and including a ramp having a projection lip at an upper portion thereof, said lip comprising means for limiting movement of said body of said binding away from said ski;

(b) a body;

(c) means for mounting said body for movement relative to said base;

(d) a jaw including means for engaging a portion of said end of said boot for retaining said end of said boot on said ski;

(e) means for mounting said jaw on said body of said binding for movement relative to said body and for movement relative to said ski;

(f) means for biasing said jaw towards said ski;

(g) means for biasing said body towards said ski;

(h) a rocking lever including a first portion in operative association with said jaw and said body, and a second portion in operative association with said base and said body, wherein said means for biasing said jaw towards said ski comprises said first portion of said rocking lever, and wherein said means for biasing said body towards said ski comprises said second portion of said rocking lever.

61. The binding of claim 58 further comprising a manual release lever which comprises means for disengaging a boot from said binding when said boot is positioned on said ski.

62. The binding of claim 58 wherein said mounting means comprises spaced lateral arms attached to said body of said binding and pivotably connected to said base.

63. The binding of claim 62 wherein said spaced lateral arms are spaced apart by a distance no greater than the width of the sole of said boot.

64. The binding of claim 58 wherein said jaw comprises an upper extension adapted to engage the upper surface of the sole of the boot, a lower extension adapted to engage a bottom surface of said boot, said jaw further including a ramp comprising an upper compressive zone, a lower opening zone adjacent to said upper zone, and a ridge positioned between said zones.

65. A safety binding adapted to releasably hold an end of a boot on a ski, said binding comprising:

(a) a base for mounting said binding to said ski;

(b) a body;

(c) means for mounting said body for movement relative to said base;

(d) a jaw including means for engaging a portion of said end of said boot for retaining said end of said boot on said ski, wherein said jaw comprises an upper extension adapted to engage the upper surface of the sole of the boot, a lower extension adapted to engage a bottom surface of said boot, said jaw further including a ramp comprising an upper compressive zone, a lower opening zone adjacent to said upper zone, and a ridge positioned between said zones, wherein said upper compressive zone comprises means for increasing the biasing force of said means for biasing said jaw and said body when said jaw pivots upwardly away from said ski, whereby said upper compressive zone is biased with increasing force and said jaw is increasingly biased back towards said ski;

(e) means for mounting said jaw on said body of said binding for movement relative to said body and for movement relative to said ski;

(f) means for biasing said jaw towards said ski;

(g) means for biasing said body towards said ski;

(h) a rocking lever including a first portion in operative association with said jaw and said body, and a second portion in operative association with said base and said body, wherein said means for biasing said jaw towards said ski comprises said first portion of said rocking lever, and wherein said means for biasing said body towards said ski comprises said second portion of said rocking lever.

66. The binding of claim 65 wherein said lower opening zone comprises means for reducing the biasing force of said means for biasing said jaw and said body and for biasing said jaw upwardly from said ski.

67. The binding of claim 58 wherein said means for biasing said jaw and body comprise elastic energy storage means, a pushing element in contact with said elastic energy storage means, and means for transferring elastic energy from said pushing element to a ramp located on an inner surface of said jaw.

68. The binding of claim 58 further comprising means for adjusting the amount of elastic energy stored in said elastic energy storage means.

69. The binding of claim 57 further comprising a manual release lever operatively associated with said jaw, said manual release lever comprising means for disengaging a boot from said binding when said boot is positioned on said ski.

70. The binding of claim 60 further comprising a manual release lever operatively associated with said jaw, said manual release lever comprising means for disengaging a boot from said binding when said boot is positioned on said ski.

71. The binding of claim 65 further comprising a manual release lever operatively associated with said jaw, said manual release lever comprising means for disengaging a boot from said binding when said boot is positioned on said ski. ,

* * * * *

UNITED STATES PATENT AND TRADEMARK OFFICE

CERTIFICATE OF CORRECTION

PATENT NO. : 4,915,407

DATED : April 10, 1990

INVENTOR(S) : Jean-Claude Brischoux

It is certified that error appears in the above-identified patent and that said Letters Patent is hereby corrected as shown below:

At column 1, line 54, change "th" to ---the---.
At column 3, line 36, change "movably" to ---movable---.
At column 5, line 50, change "only, ,in" to ---only, in---.
At column 5, line 61, change "or" to ---of---.
At column 6, line 45, delete ",".
At column 8, line 24, change "Which" to ---which---.
At column 12, line 58, claim 1, change "his" to ---is---.
At column 13, line 26, claim 5, change "aid" to ---said---.
At column 16, lines 41 and 42, claim 39, change "piVotably" to --pivotably--.
At column 17, line 66, claim 54, change "63" to ---53---.

Signed and Sealed this

Nineteenth Day of May, 1992

*Attest:*

DOUGLAS B. COMER

*Attesting Officer*

*Acting Commissioner of Patents and Trademarks*